US006736598B2

(12) United States Patent
Kleemann et al.

(10) Patent No.: US 6,736,598 B2
(45) Date of Patent: May 18, 2004

(54) PUMP WITH A HEATABLE HOUSING

(75) Inventors: Martin Kleemann, Dannstadt (DE); Helmut Nauerth, Niederhorbach (DE); Klaus-Jürgen Uhrner, Leingarten (DE)

(73) Assignees: Eichenauer Heizelemente GmbH & Co. KG, Georg-Todt-Strasse (DE); Kaco GmbH & Co. KG, Heilbronn (DE)

( * ) Notice: Subject to any disclaimer, the term of this patent is extended or adjusted under 35 U.S.C. 154(b) by 81 days.

(21) Appl. No.: 09/983,151

(22) Filed: Oct. 23, 2001

(65) Prior Publication Data

US 2002/0048513 A1 Apr. 25, 2002

(30) Foreign Application Priority Data

Oct. 25, 2000 (DE) ..... 200 18 182 U
Apr. 27, 2001 (DE) ..... 201 07 363 U

(51) Int. Cl.[7] ..... F04D 29/58

(52) U.S. Cl. ..... 415/176; 415/177; 415/178; 415/206; 415/214.1; 219/543; 219/544; 392/479; 392/480; 392/485; 392/487

(58) Field of Search ..... 415/175, 176, 415/177, 178, 206, 214.1; 392/379, 485, 487, 479, 480, 481; 219/543, 544; 403/286, 287, 291, 293, 326, 327, 329, 278

(56) References Cited

U.S. PATENT DOCUMENTS

| | | | | | |
|---|---|---|---|---|---|
| 4,172,697 | A | * | 10/1979 | Schoen | 417/372 |
| 4,466,754 | A | * | 8/1984 | Poitier | 403/11 |
| 4,599,042 | A | * | 7/1986 | Colliver | 415/204 |
| 4,865,517 | A | * | 9/1989 | Beehler | 415/214.1 |
| 4,980,537 | A | * | 12/1990 | Knauss | 392/459 |
| 5,042,269 | A | * | 8/1991 | Sullivan | 62/285 |
| 5,443,364 | A | * | 8/1995 | Mistry et al. | 415/214.1 |
| 6,536,983 | B1 | * | 3/2003 | Morefield | 403/278 |
| 6,561,759 | B1 | * | 5/2003 | Muschelknautz | 415/119 |

FOREIGN PATENT DOCUMENTS

| | | | | | |
|---|---|---|---|---|---|
| DE | 19903951 | A1 | * | 8/2000 | 415/178 |
| EP | 898928 | A1 | * | 3/1999 | 415/176 |
| FR | 2505268 | A | * | 11/1982 | 403/326 |
| GB | 609330 | A | * | 9/1947 | 415/214.1 |

* cited by examiner

*Primary Examiner*—Christopher Verdier
(74) *Attorney, Agent, or Firm*—Antonelli, Terry, Stout & Kraus, LLP

(57) ABSTRACT

A pump, particularly for washing machines, dishwashing machines or the like, having a housing and a heating device for the continuous heating of a liquid, particularly water, is proposed, in which the heating device is constructed as the circumferential wall of the housing and on one face of the heating device is arranged in sealing manner a base and on another face of the heating device is sealingly arranged a cover of the housing.

36 Claims, 5 Drawing Sheets

PUMP WITH A HEATABLE HOUSING

FIELD OF THE INVENTION

The invention relates to a pump, particularly for washing machines, dishwashing machines and the like, having a housing and a heating device for the continuous heating of a liquid, particularly water, in which the heating device is constructed as the circumferential wall of the housing.

BACKGROUND OF THE INVENTION

For heating the water necessary for operation, it is known to place in the interior of such devices heating elements such as heating coils. However, not only are the design and assembly costs also in conjunction with possible repairs, but also the direct contact of the heating elements with the water to be heated, which in particular with highly calcareous waters lead to significant reductions in the service life and efficiency of the heating coils are disadvantageous or can make necessary further constructional measures. Frequently mechanical damage occurs to the heating coils through dropping objects.

It is also known to position upstream of said devices a boiler or a separate hot-water heater, where the water is heated to the necessary temperature. However, such additional units require extra space, so that the devices either have larger dimensions or their useful volume is correspondingly reduced and are in part complicated from the design standpoint and correspondingly cost intensive.

It has finally been proposed to place a heating device on the outside of the sump container housing, but this does not lead to a uniform heating of the water.

DE 199 03 951 A1 describes a pump for washing machines, dishwashers, etc. having a housing and a heating device for continuous liquid heating, the latter having a heater located on the outside of the pump housing and a heat distributing plate positioned between the pump housing wall and the heating device for the uniform distribution of the heat produced by the heating device over the pump housing. Although this leads to a uniform heating of the water whilst avoiding the aforementioned disadvantages, it is disadvantageous in the case of the known pump that the entire pump housing is made from metal for thermal conductivity reasons and consequently requires relatively high material and manufacturing costs.

DE 197 36 794 C2 discloses a circulating pump for a dishwasher, where the pump housing is formed by heating coils embedded in a sleeve-like heater.

The upper end of the heater is circumferentially surrounded by a bearing stud of a bearing element for a spray arm, whereas the lower face terminates in free, spaced manner with respect to a bearing plate, through which only pass the heater connections. The overall construction is complicated and costly.

The problem of the invention is to propose a simple, inexpensive pump of the aforementioned type which, whilst avoiding the aforementioned disadvantages, ensures a uniform, continuous liquid heating.

SUMMARY OF THE INVENTION

According to the invention this problem is solved with a pump of the aforementioned type in that on one face of the heating device is placed in sealing manner a base and on another face of the heating device is placed in sealing manner a cover of the housing.

In the case of the pump according to the invention the heat supply consequently does not take place by indirect heating of the pump housing via heat distributing plates and instead the heating device forms part of the pump housing, whereas the remaining housing part constituted by the base and the cover is preferably made from plastic, which can be inexpensively obtained and in particular inexpensively processed. These housing parts can be made from random thermoplastic or thermosetting materials, such as polyolefins (polyethylene, polypropylene, etc.), polyamides, polyesters, polyacetates, polycarbonates, vinyl polymers, polyurethanes, etc. or from polymer blends, which have an adequate thermal stability for pump use.

In order to ensure a high efficiency of the heat transferred by the heating device to the liquid flowing through the pump, the heating device is appropriately located on an area of the housing where, for flow reasons, the formation of a temperature gradient in the liquid is avoided. The heating device is preferably located between a housing base and cover, so as to form a substantially annular housing circumferential wall. Thus, particularly with the centrifugal pumps used for liquid heating of washing machines, dishwashers, etc., where the liquid delivered by the pump passes over a circular path, it is ensured that the heat supply takes place in a high turbulence area of the liquid leading to a high heat transfer. Through the formation of an annular side wall a simply designed pump housing structure is obtained, the housing cover and housing base being made from plastic and the annular side wall can be e.g. separately manufactured.

In a preferred embodiment, the heating device has a metal ring forming at least part of the housing side wall, said ring preferably being made from high-grade steel, particularly high-grade sheet steel, or from aluminium. In the latter case the aluminium ring can e.g. be a casting or an extruded part and then the inside is coated. Alternatively the heating device can have a ring of heat conductive plastic forming at least part of the housing side wall. Then, in particular electrically conductive plastics can be provided.

Advantageously, for heating the ring forming the housing side wall, the heating device has a thick film resistor externally in contact with the ring or a tubular heater externally in contact with the ring, which is located around at least a partial circumference of the ring and consequently at least partly surrounds the same.

In the case of a heating device having a tubular heater, the ring advantageously has a corrugation at least partly receiving the tubular heater, so as on the one hand to securely and permanently fix the tubular heater to the outside of the ring and on the other so as to ensure an increased heat exchange surface between the tubular heater and the ring. Alternatively or additionally a heat distributing plate, preferably from aluminium, can be positioned between the ring and the tubular heater.

If the ring is made from an electrically conductive plastic, there is no need for the actual heating element, e.g. in the form of a tubular heater or thick film resistor and the plastic ring is then directly electrically heated.

Whereas in the case of a thermoplastic housing the ring can be directly injection moulded into the latter, when the housing is made from a thermosetting material it can be moulded into the housing. The ring can be bonded to the housing or, optionally accompanied by the interposing of seals, can be pressed with the housing.

In order to provide corrosion protection with aluminium rings, the pump heating device is preferably provided with a coating on the inside. It is also possible to provide temperature regulating devices in contact with the heating device in order to individually adjust the desired liquid temperature.

As stated, the pump is preferably a centrifugal pump.

In order to secure the connection of heating device and housing parts, according to a preferred development of the invention a retaining device embraces extensions of the housing parts. This reliably prevents any leaks of the connection, particularly if the heating element ring is a metal part and the remaining parts of the housing are made from plastic, because then as a result of the heating and cooling processes stresses can arise between the heating device and the plastic housing due to the different expansion coefficients of the materials and over a long period of time could lead to leaks at the connection. Moreover, within the pump, due to the liquid flow, an elevated pressure prevails all round, which on the one hand acts perpendicularly on the heating device and therefore presses the latter outwards and on the other the pressure also acts perpendicularly on the adjacent housing base and cover. Therefore the connection between the heating device and housing is burdened in two directions. These forces are also absorbed and compensated by the retaining device provided according to the invention. Moreover, through the use thereof the connections can be released non-destructively, i.e. a replacement of defective parts is possible. The retaining device can also be used for pressing an excess temperature protection means against the heating device, so that there is no need for an additional and separate fastening structure for the same.

Thus, this development provides for a fastening possibility reliably withstanding the internal pressure of the pump housing and rationally manufacturable in the form of the plastic housing and the heating device and which despite different expansion coefficients remains tight in the long term and in which an excess temperature protection means can be constructionally simply integrated. The overengaging retaining device can either be formed by the actual heating ring or by an additional connecting device. If the overengaging retaining device is formed by additional means, this offers the advantage that in the retaining device can simultaneously also be incorporated the fastening for the necessary excess temperature protection means.

The interposing of a seal has the advantage that the elasticity of said seal can compensate expansion coefficients and consequently creates a long term, tight connection. With the overengaging construction extensions are formed on the edges of the housing base and cover, which form the connection between the housing and the heating device and which receive the fastening structure on their side remote from the heating device and referred to here as the outside of the extension. This makes it possible to reliably counteract the pressure perpendicular to the housing base and cover. In addition, on the outside of the extension can be formed a groove, into which can, as desired, be clamped, pressed, crimped or snapped the connecting element and as a result the heating element is secured against the perpendicular pressure.

A particularly simple constructional solution arises if the overengaging connecting elements are constructed as clamps. The e.g. spring steel clamps are elastically preloaded at several points bilaterally snapping into the in this case not necessarily circumferential groove on the outside of the extension. On the inside of the extension is provided a circumferential, annular groove, which receives the heating device, accompanied by the interposing of a seal. Thus, in simple manner, a connection is created, which counteracts the lateral and also the vertical pressure on the heating element. When using clamps, the fitting of the excess temperature protection means can be especially advantageously implemented. In this case the excess temperature protection means is elastically clamped between the heating device and the clamp, optionally by means of a tongue bent out of the same.

Another possibility for creating a retaining device consists of the use of a plastic moulding, which can comprise several segments. Such a plastic moulding can be inexpensively manufactured as an injection moulding. At its ends are formed hook-like extensions engaging and hooking in identical, but opposing manner in the wall of an external groove of the plastic housing extension. Thus, a clip connection is produced through the elasticity of the plastic. The plastic connecting part is shaped in such a way that on the inside of the extension it simultaneously presses the heating device against the housing base and cover, accompanied by the interposing of a seal. Thus, here again the connecting part reliably absorbs in both directions the pressure on the heating device. On said retaining device can be shaped in simple manner a mounting support for the excess temperature protection means, so that the latter comes to rest between the retaining device and the heating device.

The segments can also be shaped in such a way that they externally completely embrace the heating device. Thus, the heating device is mechanically and electrically protected making a further housing part for protecting the heating device unnecessary.

Another simple fastening possibility is obtained through a ring of the heating device being used as an overembracing retaining device between the housing base and cover. To this end the cross-section of the ring is not planar and instead in its marginal areas and bilaterally is formed a U-shaped extension, which embraces in contour-adapted manner the plastic housing extension, accompanied by the interposing of a seal. For the final fastening the U-shaped extension of the heating device on the outside thereof is crimped or flanged into an external groove of the housing parts and is consequently secured against lateral and perpendicular pressure. With the aid of a simple clamp construction it is possible in this case to fix the excess temperature protection means to the heating element.

BRIEF DESCRIPTION OF THE DRAWINGS

The invention is described in greater detail hereinafter relative to a preferred embodiment and the attached drawings, wherein show.

DETAILED DESCRIPTION OF THE DRAWINGS

Figure 1:
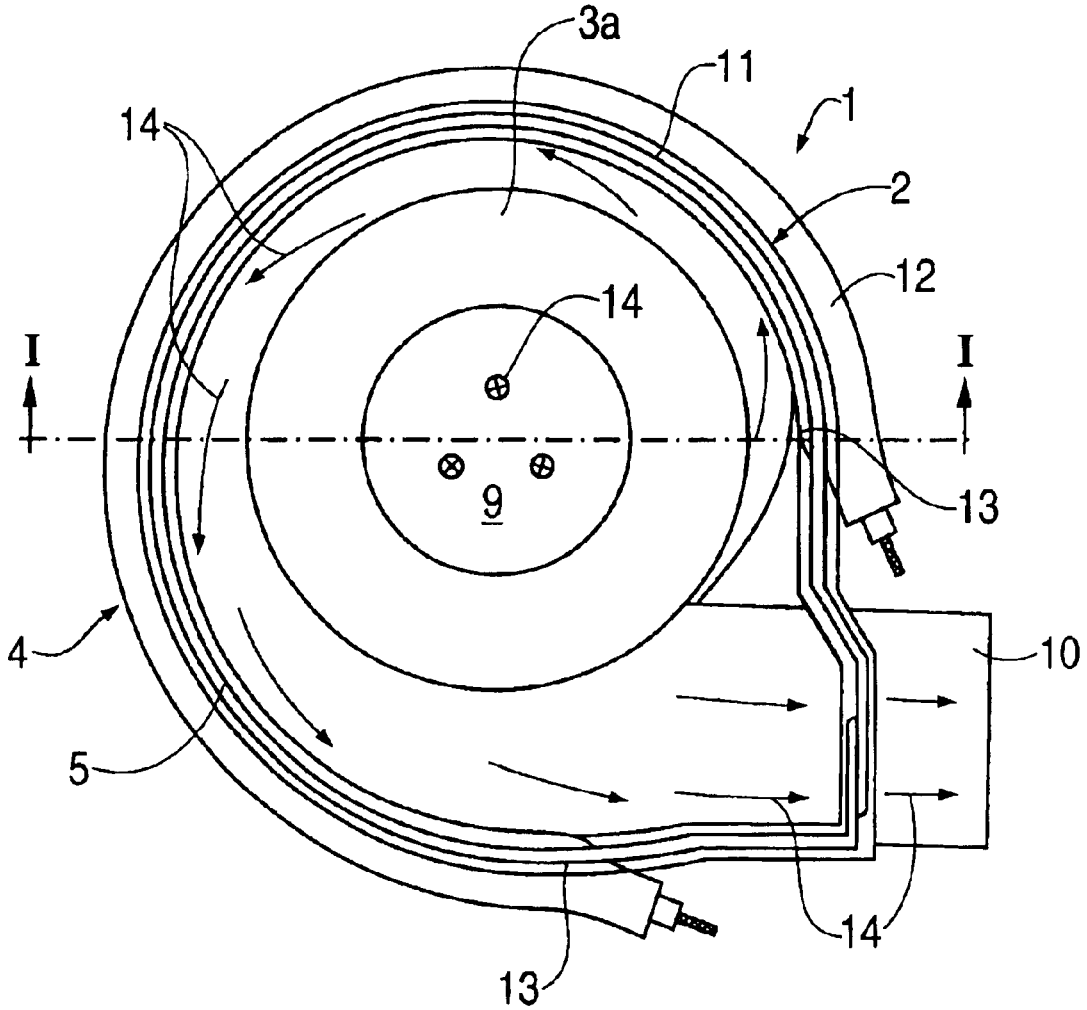
FIG. 1 An axial plan view of the pump with the housing cover removed.
Figure 2:
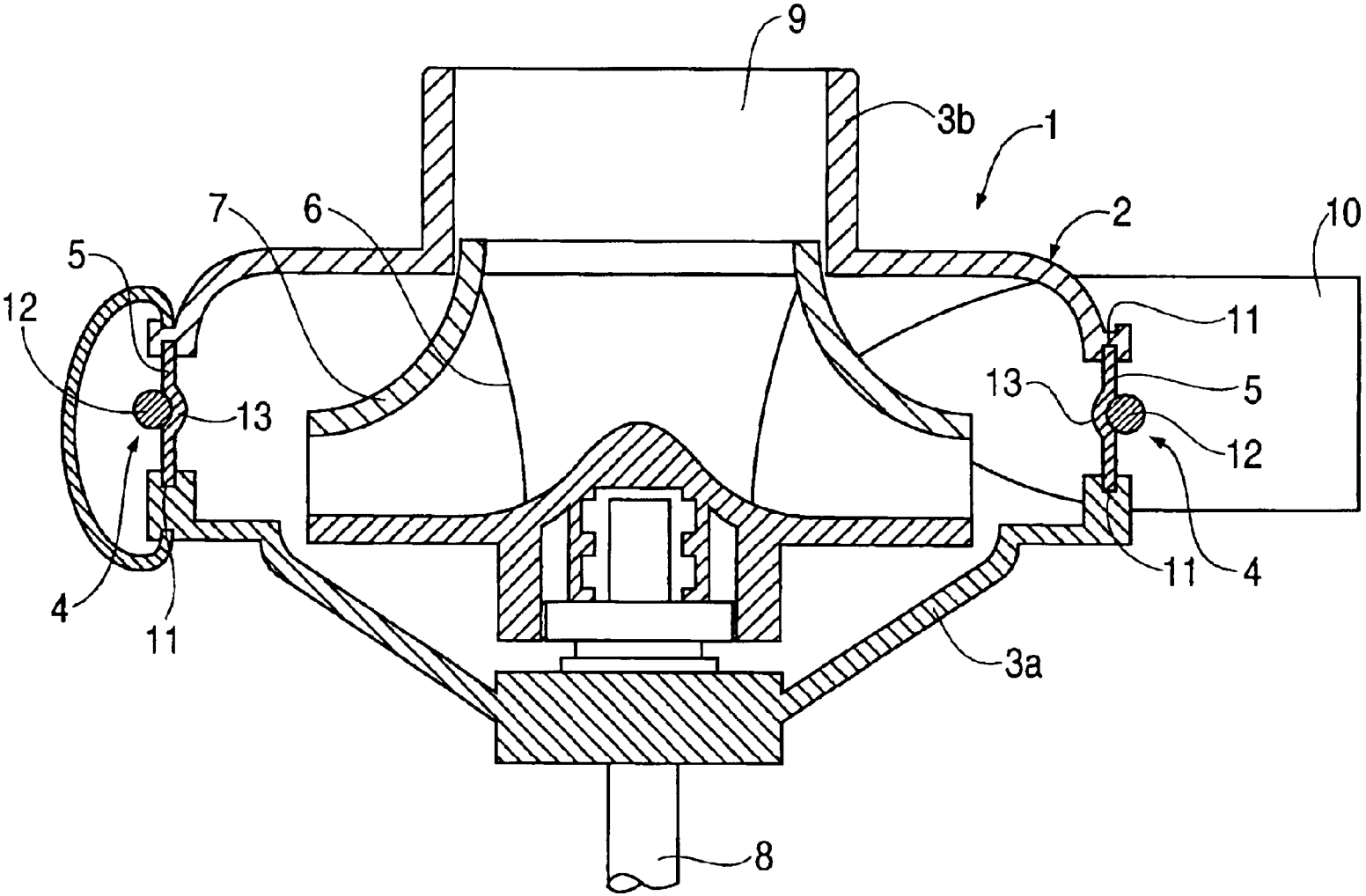
FIG. 2 A sectional view of the pump in direction I—I.

The pump 1 shown in FIGS. 1 and 2 has a three-part housing 2 with a base 3*a* and a cover 3*b* made from plastic, as well as a heating device 4, which with a cylindrical ring 5 forms the circumferential wall of the housing 2. The ring 5 is made from a heat conductive material, e.g. high-grade sheet steel. The pump 1 is constructed in the manner of a centrifugal pump and has a rotary impeller 7 provided with blades 6 and which is driven by means of a pump shaft 8 mounted centrally in the housing base 3*a*. For supplying the liquid to be pumped is provided a suction line 9 issuing from above into the housing 2 of the pump and for removing said liquid the housing 2 has a laterally positioned diffuser 10.

Figure 3:
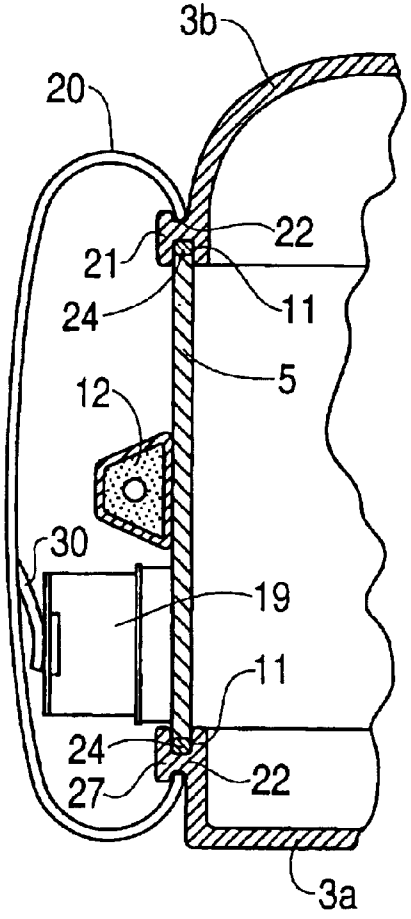
FIG. 3 A larger scale representation of a section of the radial marginal area of the embodiment of FIG. 1 of the pump according to the invention.

On the face of the housing cover 3*b* facing the housing base 3*a*, as well as on the face of the housing base 3*a* congruent with and facing the face of the housing cover 3*b* is provided an annular groove 11 formed in annular extensions 21 on the circumferential edge of the housing base 3*a* and cover 3*b* and in which is received the ring 5 of the heating device 4. The ring 5 can e.g. be bonded into the annular groove 11 or pressed therewith accompanied by the interposing of seals (FIG. 3). Alternatively the ring 5 can be injection moulded or moulded in in the housing base 3*a* and/or the housing cover 3*b* in the form of a plastics material.

Figure 7:
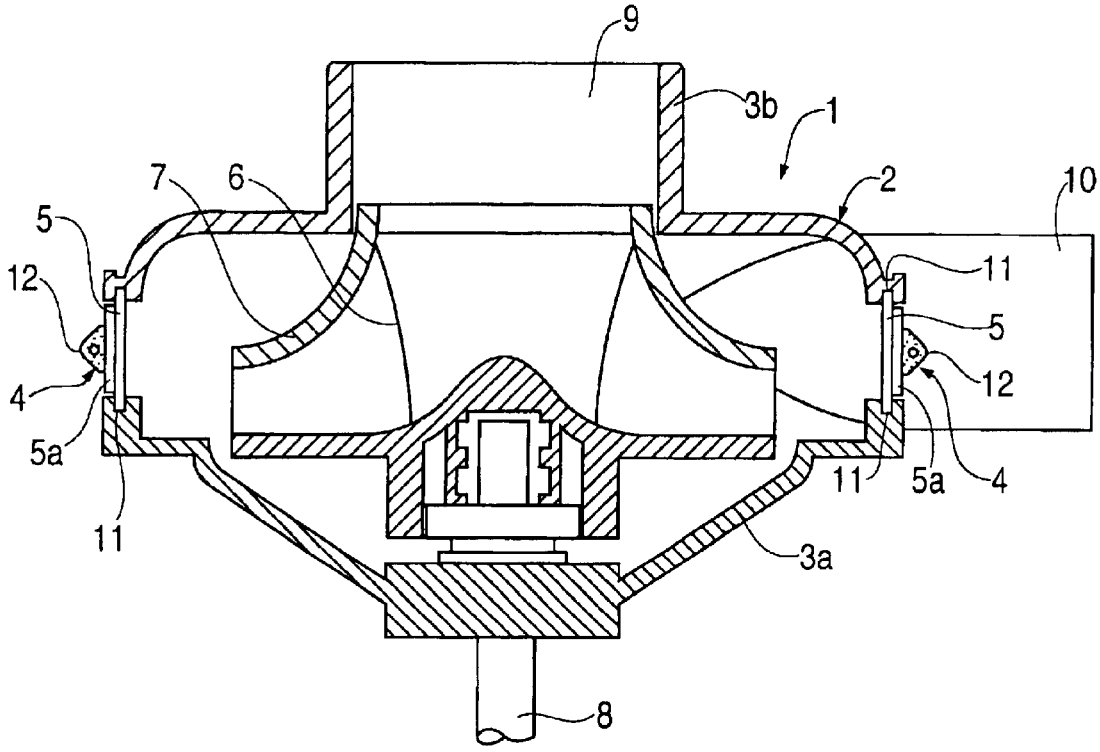
FIG. 7 A section corresponding to FIG. 3 of a further embodiment of the pump according to the invention.

The ring 5 forming the central portion of the side wall of housing 2 is externally connected, e.g. soldered to a tubular heater 12 located on most of the circumference of the ring 5 and in the represented embodiment about a circumferential portion of ring 5 of approximately 300° (FIG. 1). For increasing the heat exchange surface area between the tubular heater 12 and the ring 5 and for fixing the tubular heater the latter is equipped with a substantially central, inwardly directed corrugation 13 receiving the tubular heater 12. Alternatively or additionally e.g. the tubular heater 12 can be provided with heat distributing plates 5*a*, e.g., made from aluminum, linking the tubular heater 12 with the ring 5 as shown in FIG. 7. A temperature regulating device (FIGS. 3 to 5) can also be fitted to the outside of the ring 5.

As can be gathered from FIG. 1, the pump 1 is centrally supplied with the liquid being pumped by the suction line 9 and is then passed by means of the impeller 7 (not shown in FIG. 2) in a circular path along the inner circumference of the ring 5 heated by the tubular heater 12 (directional arrow 14), prior to it leaving the pump 1 via the diffuser 10. Whilst passing through the circular path, as a result of the turbulence prevailing there, the liquid is rapidly heated and the formation of a temperature gradient in the liquid is avoided, so that a high efficiency is achieved.

The marginal area of the pump having the heating device 4 and clamp 20 is shown on a larger scale and in greater detail in FIG. 3. It can be seen that the ring 5 is inserted in the inner annular groove 11, accompanied by the interposing of a seal 24. A tongue 30 is bent out of the clamp 20. An excess temperature protection means 19 is clamped between the ring 5 and the tongue 30. Additionally the excess temperature protection means 19 can be bonded (not shown in FIG. 1).

Figure 4:
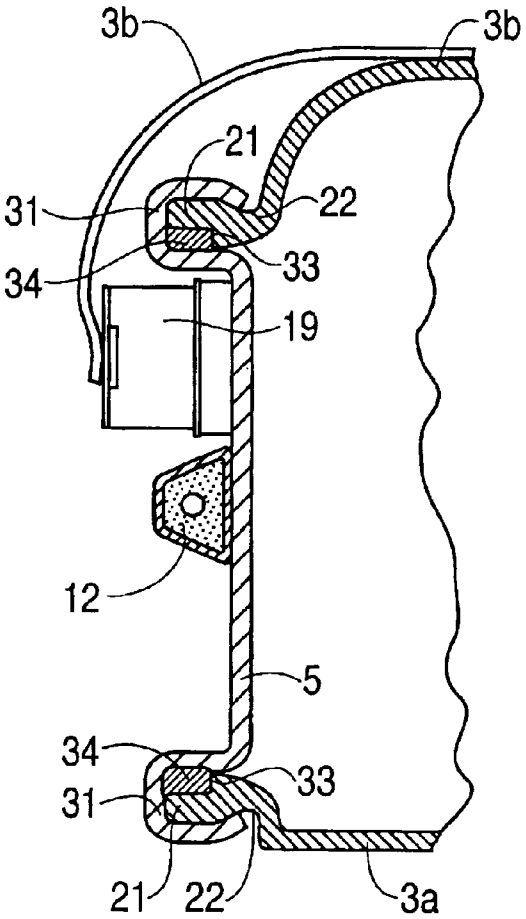
FIG. 4 A section corresponding to FIG. 3 of another embodiment of the pump according to the invention.

In FIG. 4 a retaining device is formed by the ring 5. For this purpose are formed on the outsides of the ring 5 U-shaped annular extensions 31, which engage over the extensions 21 of housing base 3*a* and cover 3*b*. An annular recess 33 on the inside of the extensions 21 receives the annular seal 34. The groove 22 on the outside of the extensions 21 can either be shaped beforehand or can be formed by the crimping or flanging of the free ends of the annular extensions 31 of ring 5. A spring element 36, which is e.g. fixed to the housing cover 3*b*, maintains an excess temperature protection means 19 clamped on the heating device 4, which can optionally additionally be fixed with an adhesive.

Figure 5:
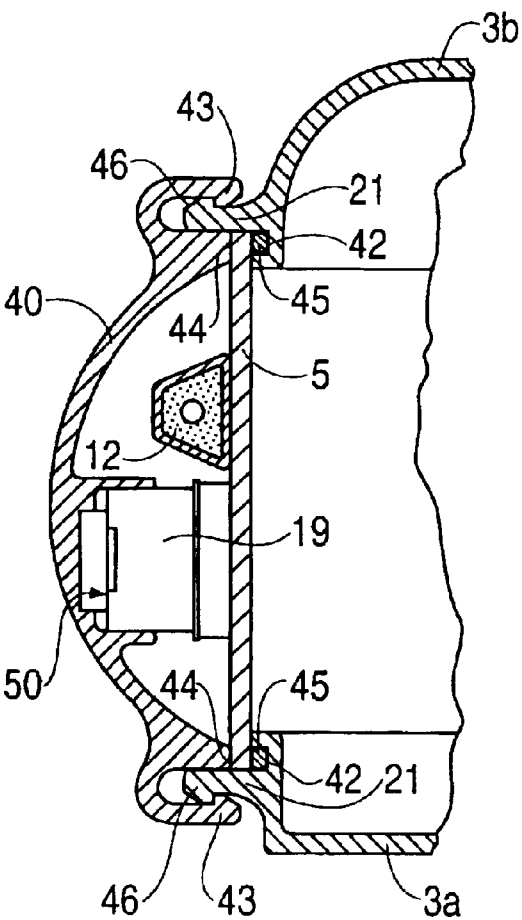
FIG. 5 A section corresponding to FIG. 3 of a further embodiment of the pump according to the invention.

In the construction of FIG. 5 the retaining device is formed by one or more segments of a plastic moulding 40. Hook-like, undercut noses 43 are formed at the ends of the moulding 40. On the outsides of the extensions 21 of housing base 3*a* and cover 3*b* are formed noses 46 in opposing, identical manner thereto. Both parts engage in one another in such a way that the hook-like noses 43 of the plastic moulding 40 engage over and behind the hooks 46. Due to the elasticity of the plastic this leads to a clip connection. In its inner area the extension 21 also has a radially outwardly open annular groove 42, which receives a seal 45. With the aid of annular clamping noses 44 of the retaining device 40 the ring 5 is pressed against the seals 45 under the pressure produced by the clip connection. Onto the inside of the plastic part 40 is shaped a mounting support 50 for the excess temperature protection means 19 with the aid of which it is held on the heating device 4. If the plastic segments are arranged all round the heating device 4, simultaneously there is a mechanical and electrical protection of said heating device.

Figure 6:
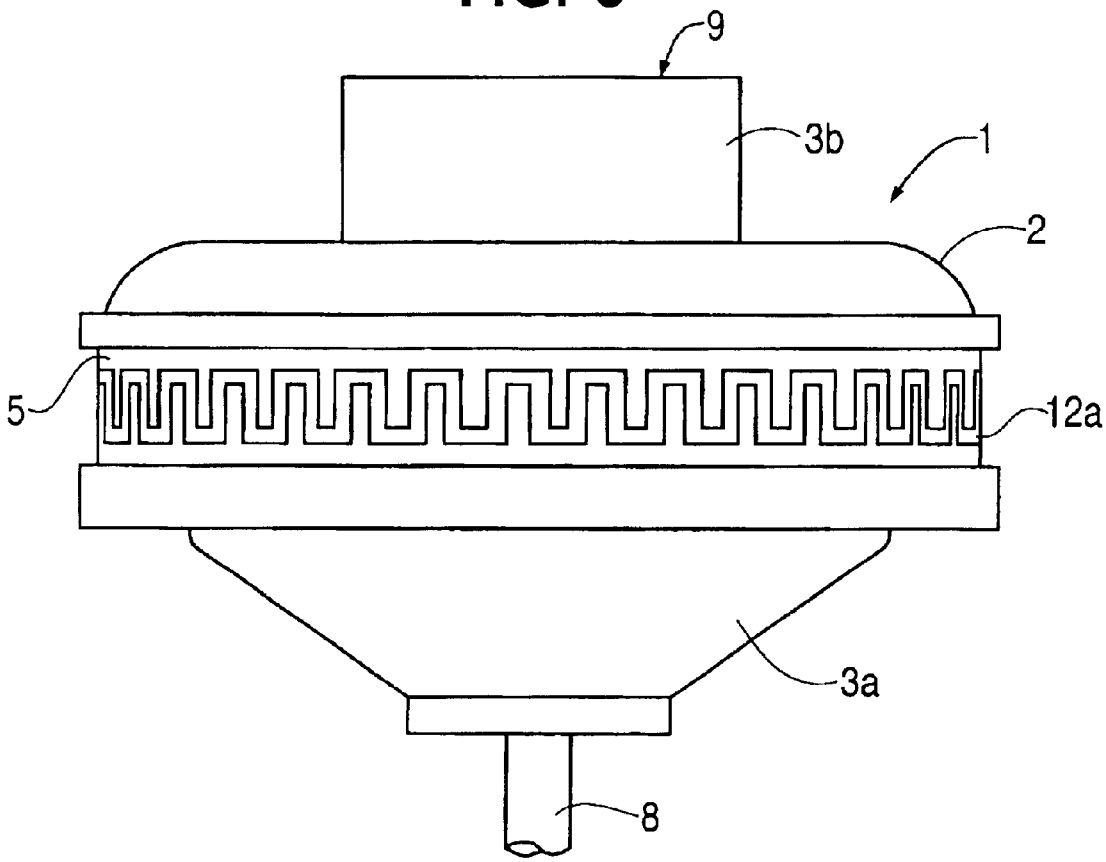
FIG. 6 A section corresponding to FIG. 3 of a further embodiment of the pump according to the invention.

An essential advantage of the invention is consequently the simple, inexpensive construction of the housing base 3*a* and cover 3*b* from plastic, accompanied by a high flexibility when using the particular heating element of the heating device 4 and e.g. in place of a tubular heater 12 use can be made of a thick film resistor or random other heating elements without modifying the arrangement or construction of the housing 2. As shown in FIG. 6, a thick film resistor 12*a* can be placed in contact with and around at least a partial circumference of the ring 5. Through the placing of the heating device 4 on the annular side wall of the pump housing 2 in the vicinity of the impeller 7, simultaneously a high heat transfer efficiency to the liquid being pumped is ensured.

What is claimed is:

1. Pump comprising a housing and a heating device for the continuous heating of a liquid, the heating device being constructed as a circumferential wall of the housing, characterized in that on one face of the heating device is arranged in sealing manner a base and on another face of the heating device is arranged in sealing manner a cover of the housing.

2. Pump according to claim 1, characterized in that the heating device has a metal ring forming at least part of the circumferential wall of the housing.

3. Pump according to claim 2, characterized in that the ring is made from high-grade steel.

4. Pump according to claim 2, characterized in that the ring is made from aluminium.

5. Pump according to claim 4, characterized in that the aluminium ring is a casting.

6. Pump according to claim 4, characterized in that the alunimium ring is an extruded part.

7. Pump according to claim 1, characterized in that the heating device has a heat conductive plastic ring forming at least part of the circumferential wall of the housing.

8. Pump according to claim 7, characterized in that the ring is made from an electrically conductive plastic.

9. Pump according to claim 2, characterized in that the heating device has a thick film resistor externally in contact with the ring.

10. Pump according to claim 2, characterized in that the heating device has a tubular heater externally in contact with the ring.

11. Pump according to claim 2, characterized in that a tubular heater or a thick film resistor is placed around at least a partial circumference of the ring.

12. Pump according to claim 10, characterized in that the ring has a corrugation at least partly receiving the tubular heater.

13. Pump according to claim 10, characterized in that a heat distributing plate is placed between the ring and the tubular heater.

14. Pump according to claim 13, characterized in that the heat distributing plate is made from aluminium.

15. Pump according to claim 2, characterized in that the base and cover are made from a thermoplastic material and the ring is injection moulded in as part of the housing.

16. Pump according to claim 4, characterized in that the base and cover are made from a thermosetting plastic and the ring is moulded into the housing.

17. Pump according to claim 2, characterized in that the ring is bonded to the base and cover.

18. Pump according to claim 2, characterized in that the ring is pressed with the base and cover.

19. Pump according to claim 1, characterized in that a temperature regulating device in contact with the heating device is provided.

20. Pump according to claim 1, characterized in that the pump is a centrifugal pump.

21. Pump comprising a housing and a heating device for the continuous heating of a liquid, in which the heating device is constructed as the circumferential wall of the housing, characterized in that a retaining device embraces extensions of a base and a cover of the housing.

22. Pump according to claim 21, characterized in that the retaining device has clamps.

23. Pump according to claim 22, characterized in that the clamps engage in grooves on the outside of the extensions of the base and cover of the housing.

24. Pump according to claim 21, characterized in that onto the insides of the extensions of the base and cover of the housing is shaped an annular groove for receiving the heating device, accompanied by the interposing of a seal.

25. Pump according to claim 21, characterized in that a tongue is bent out of a clamp and with the aid thereof an excess temperature protection means is clamped between the heating device and the clamp.

26. Pump according to claim 21, characterized in that the retaining device is formed from one or more plastic mouldings.

27. Pump according to claim 26, characterized in that on the ends of the plastic mouldings are shaped hook-like noses, which engage in identical and opposing hooks on the outside of the extensions of the base and the cover of the housing.

28. Pump according to claim 26, characterized in that the heating device is bilaterally fixed between an annular groove, receiving a seal, of the inside of the extensions of the base and cover of the housing and annular clamping noses of the plastic moulding.

29. Pump according to claim 21, characterized in that on at least one plastic moulding is shaped a mounting support for excess temperature protection means in such a way that said excess temperature protection means is elastically applied to the heating device.

30. Pump according to claim 21, characterized in that the retaining device is constructed on the heating device.

31. Pump according to claim 30, characterized in that on the heating device are bilaterally shaped U-shaped extensions in which engage the extensions of the base and cover of the housing.

32. Pump according to claim 31, characterized in that a seal engages between the U-shaped extensions and the extensions of the base and cover of the housing.

33. Pump according to claim 31, characterized in that the U-shaped extensions and the extensions of the base and cover of the housing are connected all round by crimping or flanging in.

34. Pump according to claim 21, characterized in that a clip is so fixed to one of the base and cover of the housing that between the clip and the heating device is elastically secured an excess temperature protection means.

35. Pump according to claim 2, characterized in that the ring is made from high-grade sheet steel.

36. Pump according to claim 22, wherein the clamps are made of spring steel.

* * * * *